US007488932B2

(12) United States Patent
Ting

(10) Patent No.: US 7,488,932 B2
(45) Date of Patent: Feb. 10, 2009

(54) APPARATUS FOR PRODUCING ATOMIC BEAM

(75) Inventor: Chin-Kuo Ting, Gueishan Township, Taoyuan County (TW)

(73) Assignee: AU Optronics Corp., Hsinchu (TW)

( * ) Notice: Subject to any disclaimer, the term of this patent is extended or adjusted under 35 U.S.C. 154(b) by 230 days.

(21) Appl. No.: 11/454,361

(22) Filed: Jun. 15, 2006

(65) Prior Publication Data

US 2007/0057203 A1 Mar. 15, 2007

(30) Foreign Application Priority Data

Sep. 13, 2005 (TW) ..... 94131433 A

(51) Int. Cl.
*H05H 3/02* (2006.01)

(52) U.S. Cl. ..... 250/251; 250/423 R; 250/396 R

(58) Field of Classification Search ..... 250/251
See application file for complete search history.

(56) References Cited

U.S. PATENT DOCUMENTS 3,847,115 A * 11/1974 Tashbar ..... 118/712
4,782,235 A * 11/1988 Lejeune et al. ..... 250/423 R
5,094,879 A * 3/1992 Matsuda et al. ..... 427/571
5,462,629 A * 10/1995 Kubota et al. ..... 156/345.55
5,739,528 A * 4/1998 Kato ..... 250/251
6,501,081 B1 * 12/2002 Foad et al. ..... 250/492.21
2002/0033446 A1 * 3/2002 Ichimura et al. ..... 250/251

FOREIGN PATENT DOCUMENTS

JP 61-86699 5/1986
JP 08-233998 9/1996
JP 2000-122064 4/2000

* cited by examiner

*Primary Examiner*—Nikita Wells
*Assistant Examiner*—Johnnie L Smith, II
(74) *Attorney, Agent, or Firm*—J.C. Patents

(57) ABSTRACT

An apparatus for producing an atomic beam comprising an ionization chamber, an ion beam drawing device, a neutralization chamber and a voltage regulating device is provided. The ionization chamber generates an ion beam and the ion beam drawing device draws the ion beam out from the ionization chamber. The neutralization chamber and the voltage regulating device are disposed on the path of the ion beam. Moreover, the ion beam drawing device is disposed between the ionization chamber and the neutralization chamber and the voltage regulating device is disposed between the ion beam drawing device and the neutralization chamber. The energy of the ion beam can be reduced by the voltage regulating device. The ion beam is neutralized to a neutral atomic beam after passing through the neutralization chamber. Therefore, the apparatus for producing the atomic beam provided in this invention can effectively produce the neutral atomic beam.

12 Claims, 1 Drawing Sheet

APPARATUS FOR PRODUCING ATOMIC BEAM

CROSS-REFERENCE TO RELATED APPLICATION

This application claims the priority benefit of Taiwan application serial no. 94131433, filed on Sep. 13, 2005. All disclosure of the Taiwan application is incorporated herein by reference.

BACKGROUND OF THE INVENTION

1. Field of the Invention

The present invention relates to an apparatus for producing an atomic beam. More particularly, the present invention relates to an apparatus for producing the atomic beam, suitable for alignment treatment on alignment layer materials.

2. Description of Related Art

In today's society, highly developed multimedia technology benefits mostly from the advance of semiconductor devices and display units. Among the display monitors, the liquid-crystal display with the superior characteristics of high picture quality, compactness, low power consumption and no radiation has gradually become the mainstream in the market.

The liquid-crystal display mainly is composed of two pieces of substrates as well as one liquid crystal layer in-between. For either the active matrix type liquid-crystal display or the passive matrix type liquid-crystal display, two alignment layers are disposed respectively on both substrates, and the main function of the alignment layers lies in aligning the liquid crystal molecules, causing the liquid crystal molecules to be twisted between the two substrates. The conventional manufacturing procedure of the alignment layer mainly includes two parts: the thin film fabrication and the alignment treatment.

In details, the material of the above alignment layer can be polyimide, hydrogenated diamond like carbon (DLC), silicon carbide (SiC) or $SiO_2$. At present, the alignment treatment of the alignment layer can be classified as the contact type and non-contact type approaches. The so-called contact type alignment treatment usually is performed by rubbing the alignment layer materials. And the non-contact type ion beam alignment treatment is performed by utilizing the atomic beam bombardment with specific tilt angles to the surface of alignment layer.

Regarding the non-contact type alignment treatment, since the energy of ion beam generated by the non-contact type ion beam alignment apparatus is rather high and the ion beam usually can not be completely neutralized into the neutral atomic beam, the alignment layer may easily be damaged. The traditional non-contact type ion beam alignment treatment includes firstly inducing high energy ion beam, and followed by introducing the inert gas for colliding with the ion beam collides to generate low energy secondary atoms. Those low energy secondary atoms bombard the alignment layer materials for the alignment treatment. However, by using this kind of low energy secondary atoms that are generated through the collision of high energy ion beam with the inert gas, the uniformity of the treated alignment layer is poor. Moreover, effective neutralization can not be achieved for the treatment method by converting the ion beam to the atomic beam through charge transfer. Therefore, the traditional non-contact type ion beam alignment treatment can easily damage the alignment layer and deteriorate the quality of the alignment layer. Also, it is most likely to cause uneven alignment for the alignment layer. Nevertheless, if the energy of the ion beam is reduced for alleviating the above issues, the beam current of the ion beam is smaller, thus increasing the time required for the alignment treatment and lowering the yield.

SUMMARY OF THE INVENTION

According to an aspect of the present invention, an apparatus for producing the atomic beam is provided, which apparatus can effectively produce the neutral atomic beam.

According to another aspect of the present invention, a method for producing atomic beam is provided, which can convert the ion beam of high energy into the neutral atomic beam of moderate energy.

The present invention provides an apparatus for producing atomic beam, comprising: an ionization chamber, an ion beam drawing device, a neutralization chamber and a voltage regulating device. The ionization chamber is used to produce an ion beam and the ion beam drawing device is used to draw the ion beam out from the ionization chamber. The neutralization chamber is disposed on the path of the ion beam, and the ion beam drawing device is disposed between the ionization chamber and the neutralization chamber. Moreover, the ion beam is neutralized to a neutral atomic beam after passing through the neutralization chamber. Besides, the voltage regulating device is disposed on the path of the ion beam, and disposed between the ion beam drawing device and the neutralization chamber.

According to one preferred embodiment of this invention, the voltage regulating device comprises a plurality of deceleration electrodes.

According to one preferred embodiment of this invention, the voltage of the voltage regulating device is 50~5000 V lower than that of the ion beam drawing device.

According to one preferred embodiment of this invention, the neutralization chamber comprises one electric arc chamber and one chamber. An electron cloud is produced in the electric arc chamber, and the chamber is disposed on the path of the ion beam and connected to the electric arc chamber, allowing the electron cloud to enter the chamber.

According to one preferred embodiment of this invention, the electric arc chamber comprises one heating filament as well as one inert gas supply device.

According to one preferred embodiment of this invention, the heating filament is applied with a voltage of 5~30 V and a current of 5~20 A.

According to one preferred embodiment of this invention, the inert gas supply device can provide gases including helium, neon, argon, krypton and xenon.

According to one preferred embodiment of this invention, the gas flow rate of the inert gas supply device is about 10~50 sccm.

According to one preferred embodiment of this invention, the chamber also installs an electron extraction electrode which extracts the electron cloud into the chamber.

According to one preferred embodiment of this invention, the ion beam drawing device comprises at least one extraction electrode and/or at least one focal electrode.

The present invention provides a method for producing atomic beam, comprising the following steps: providing an ion beam; lowering the energy; and generating an electron cloud and guiding the ion beam through the electron cloud, to neutralize the ion beam to a neutral atomic beam.

According to one preferred embodiment of this invention, the method to lower the energy of ion beam comprises installing a voltage regulating device that is disposed on the path of the ion beam.

According to one preferred embodiment of this invention, the method to generate electron cloud comprises introducing an inert gas into the electric arc chamber in which the inert gas collides with hot electrons.

According to the present invention, the above method can effectively produce the neutral atomic beam of moderate energy by lowering the energy of the ion beam via a voltage regulating device, and allowing the ion beam go through the electron cloud that is generated within the neutralization chamber. Therefore, using the atomic beam generated by the apparatus in this invention for the alignment treatment, the treated alignment layer affords a better alignment quality without compromising the alignment efficiency.

These and other exemplary embodiments, features, aspects, and advantages of the present invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE EMBODIMENTS

Figure 1:
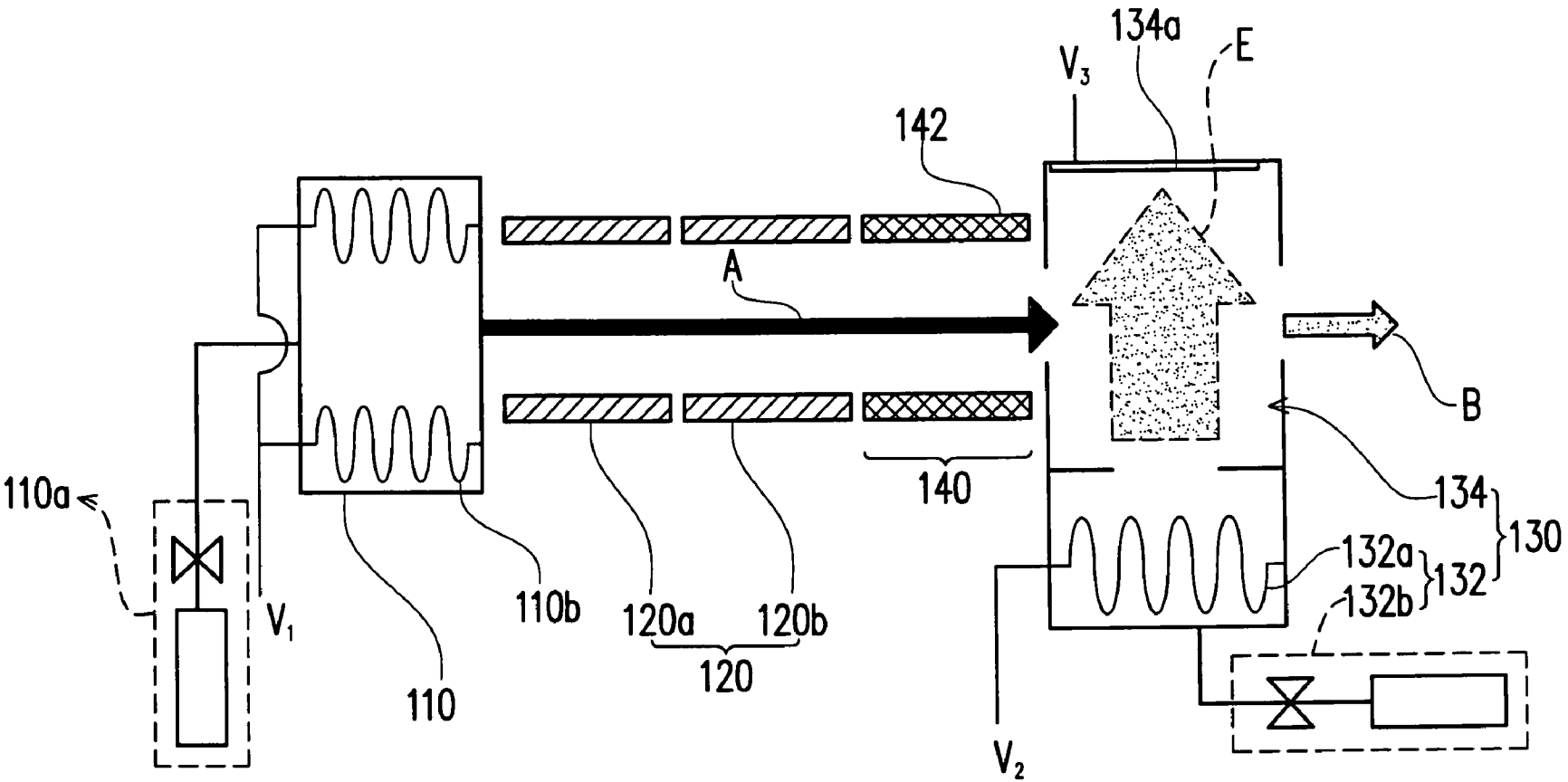
FIG. 1 illustrates the apparatus for producing the atomic beam according to one preferred embodiment of the present invention.

FIG. 1 illustrates the apparatus for producing atomic beam according to one preferred embodiment of the present invention. Referring to FIG. 1, the apparatus for producing atomic beam 100 according to the present invention comprises an ionization chamber 110, an ion beam drawing device 120, a neutralization chamber 130 and a voltage regulating device 140. Among them, the ionization chamber 110 is used to generate an ion beam A, the ion beam drawing device 120 is used to draw ion beam A out of the ionization chamber 110. According to one preferred embodiment of this invention, ionization chamber 110 comprises an inert gas supply device 110*a* and a heating filament 110*b*. By introducing inert gases of large atomic numbers, such as Ar or Kr, via the inert gas supply device, and applying voltage V1 on heating filament 110*b*, inert gas will be ionized and ion beam A is generated.

Then, ion beam A will be drawn out from ionization chamber 110 through ion beam drawing device 120. This ion beam drawing device 120 comprises at least one extraction electrode and/or at least one focal electrode 120*b*. According to one embodiment of this invention, the voltage of the extraction electrode 120*a* is 3000V. The extraction electrode 120*a* extracts ion beam A from ionization chamber 110 and ion beam A has high energy (3000 eV). With the assistance of focal electrode 120*b*, this high-energy ion beam A will advance in parallel, and not stray away due to the repulsion forces among ions. Certainly, the number of above extraction electrode 120*a* and/or focal electrode 120*b* can be adjusted based on the needs of actual conditions.

In addition, the neutralization chamber 130 and the voltage regulating device 140 are disposed on the path of the ion beam A, and the ion beam drawing device 120 is disposed between the neutralization chamber 130 and the ionization chamber 110, and the voltage regulating device 140 is disposed between the ion beam drawing device 120 and the neutralization chamber 130. Because high-energy ion beam A may easily cause damages to the alignment layer, a voltage regulating device 140 is installed to reduce the energy of ion beam A.

In detail, this voltage regulating device 140 may comprises a plurality of deceleration electrode 142. The voltage of this voltage regulating device 140 can be adjusted to be, for example, 50~5000 V lower than that of the ion beam drawing device 120. Thus, the energy of ion beam A will be lowered to the desired range due to the influence of deceleration electrode 142 and the desired range for the energy of the ion beam A can be changed based on the needs of actual conditions.

Specifically, according to one embodiment of this invention, the voltage of deceleration electrode 142 is −2800 V. Through deceleration electrode 142, the energy of the high-energy ion beam A is lowered to 200 electron-volts (eV) from the original 3000 eV. Therefore, via deceleration electrode 142, the operator could lower the high energy of ion beam A to the level suitable for the alignment treatment on the alignment layer materials.

Since the energy of ion beam A is lowered by passing through deceleration electrode 142, the ion beam A in this invention can maintain high beam current for the alignment treatment. Therefore, compares to the conventional technology, ion beam A in this invention can reduce the processing time and increases the yield.

After passing through the voltage regulating device 140, the ion beam A will enter into the neutralization chamber 130, then be neutralized to a neutral atomic beam B. According to one embodiment of this invention, the above neutralization chamber 130 comprises an electric arc chamber 132 and a chamber 134. The electric arc chamber 132 is used to produce one electron cloud E, and the chamber 134 is disposed on the path of the ion beam and connected with electric arc chamber 132, making it possible for the electron cloud E to enter the chamber 134. In detail, electric arc chamber 132 comprises one heating filament 132*a* as well as one inert gas supply device 132*b*, and the chamber 134 comprises an electron extraction electrode 134*a*, this extraction electrode 134*a* can guide the electron cloud E into the chamber 134.

According to one embodiment of this invention, the inert gas supply device 132*b* introduces at least an inert gas into the chamber 132 at the gas flow rate of 10~50 sccm, for example, and the inert gas can be helium, neon, argon, krypton or xenon. In addition, hot electrons generated by heating filament 132*a* (heating filament's voltage V2 is about 5~30 V, its current is about 5~20 A) collide with the inert gas to generate electrons and positive ions. Moreover, the voltage V3 that applied on the electron extraction electrode 134*a* is 10 V, this electron extraction electrode 134*a* can extract the generated electrons into the chamber 134 from the electric arc chamber 132, so as to form an electron cloud E in the chamber 134.

Particularly, electrons in the electron cloud E have a much lower energy (10 eV). When ion beam A passing through electron cloud E, electrical neutralization occurs between electrons within the electron cloud E and the ion beam A, thus converting ion beam A into neutral atomic beam B. In addition, since the electron cloud E can totally cover ion beam A, the efficiency of electrical neutralization between electrons within the electron cloud E and the ion beam is very high, thus avoiding the adverse influences of charged ion beam A on the alignment layer.

The above method for producing neutral atomic beam mainly comprises the following steps: firstly, providing an ion beam A; then, lowering the energy of ion beam A; and generating an electron cloud E and allow ion beam A pass through the electron cloud E, so as to neutralize the ion beam A to a neutral atomic beam B. In this embodiment, the above ion beam A is generated within ionization chamber 110, and a voltage regulating device 140 is disposed on the path of ion beam A for lowering the energy of ion beam A. Operator can adjust the working voltage of the voltage regulating device based on the needs of actual conditions, so as to lower the energy of ion beam A to the suitable range for the alignment treatment of the alignment layer materials. In addition, the method for generating electron cloud E comprises filling the electric arc chamber 132 with an inert gas, where the inert gas collides with hot electrons, and the generated electrons form the electron cloud E with the assistance of electron extraction electrode 134*a*.

Compare to the conventional technology, the neutral atomic beam produced in present invention has the moderate energy. It causes no damages on the alignment layer during the alignment treatment and also improves the prior problems of non-uniform alignment treatment or low production yield.

In summary, this invention at least has the following advantages:

First, since the apparatus for producing the atomic beam in the present invention comprises a voltage regulating device, this voltage regulating device can be used to lower the energy of the ion beam, thus preventing the high-energy ion beam from damaging the alignment layer. In addition, since the voltage of the ion beam drawing device has not been lowered in present invention, the prior problem of long alignment treatment time can be avoided.

Second, in present invention, the neutral atomic beam is produced by neutralization between the ion beam and the electron cloud. Compare to the conventional method that neutralizes the ion beam through charge transfer, the method provided in this invention has much higher neutralization efficiency and, thus avoiding the non-neutralized ion beam from damaging the alignment layer.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for producing an atomic beam, comprising:

an ionization chamber, used to generate an ion beam;

an ion beam drawing device, used to draw the ion beam from the ionization chamber;

a neutralization chamber, disposed on a path of the ion beam, wherein the ion beam drawing device is disposed between the neutralization chamber and the ionization chamber, and wherein after the ion beam passes through the neutralization chamber, the ion beam is neutralized to a neutral atomic beam; and a voltage regulating device, disposed on the path of the ion beam and disposed between the ion beam drawing device and the neutralization chamber, wherein the voltage regulating device comprises a plurality of deceleration electrodes, each deceleration electrode has a long side and a short side, and the long side of the deceleration electrode is substantially parallel to the ion beam.

2. The apparatus of claim 1, wherein a voltage of the voltage regulating device is 50~5000 V lower than that of the ion beam drawing device.

3. The apparatus of claim 1, wherein the voltage regulating device adjusts an energy of the ion beam.

4. The apparatus of claim 1, wherein the neutralization chamber comprises:

an electric arc chamber, used to generate an electron cloud; and a chamber, disposed on the path of the ion beam and connected to the electric arc chamber, wherein the electron cloud enter the chamber.

5. The apparatus of claim 4, wherein the electric arc chamber comprises a heating filament and an inert gas supply device.

6. The apparatus of claim 5, wherein the heating filament is applied with a voltage of 5~30 V and a current of 5~20 A.

7. The apparatus of claim 5, wherein the inert gas supply device provide at least a gas selected from the group consisting of helium, neon, argon, krypton and xenon.

8. The apparatus of claim 5, wherein a gas flow rate of the inert gas supply device is about 10~50 seem.

9. The apparatus of claim 4, wherein the chamber comprises an electron extraction electrode for extracting the electron cloud to the chamber.

10. The apparatus of claim 1, wherein the ion beam drawing device comprises at least one extraction electrode, at least one focal electrode or the combination of at least one extraction electrode and at least one focal electrode.

11. A method for producing an atomic beam, comprising:

providing an ion beam;

lowering an energy of the ion beam by Passing the ion beam through a plurality of deceleration electrodes disposed along a path of the ion beam, wherein each deceleration electrode has a lone side and a short side, and the long side of the deceleration electrode is substantially parallel to the ion beam; and generating an electron cloud, and allowing the ion beam go through the electron cloud, so as to neutralize the ion beam to a neutral atomic beam.

12. The method of claim 11, wherein the method to generate the electron cloud comprises introducing an inert gas into an electric arc chamber where the inert gas collides with hot electrons.

* * * * *